US005642618A

United States Patent [19]

Penswick

[11] Patent Number: 5,642,618

[45] Date of Patent: Jul. 1, 1997

[54] COMBINATION GAS AND FLEXURE SPRING CONSTRUCTION FOR FREE PISTON DEVICES

[75] Inventor: Laurence B. Penswick, Richland, Wash.

[73] Assignee: Stirling Technology Company, Kennewick, Wash.

[21] Appl. No.: 675,995

[22] Filed: Jul. 9, 1996

[51] Int. Cl.[6] ..... F02G 1/04

[52] U.S. Cl. ..... 60/520

[58] Field of Search ..... 60/517, 520; 92/181 P; 62/6

[56] References Cited

U.S. PATENT DOCUMENTS

| | | | |
|---|---|---|---|
| 4,532,766 | 8/1985 | White et al. | 60/517 |
| 4,996,841 | 3/1991 | Meijer et al. | 60/517 |
| 5,074,114 | 12/1991 | Meijer et al. | 60/517 |
| 5,088,284 | 2/1992 | Momose | 60/517 |
| 5,461,859 | 10/1995 | Beale et al. | 60/517 |
| 5,522,214 | 6/1996 | Beckett et al. | 60/517 |

*Primary Examiner*—Ira S. Lazarus
*Assistant Examiner*—Alfred Basichas
*Attorney, Agent, or Firm*—Wells, St. Johns, Roberts, Gregory & Matkin, P.S.

[57] ABSTRACT

A displacer assembly for use in a thermal regenerative machine has a housing with a displacer bore configured to carry a displacer in the displacer bore. A flexure bearing assembly is configured to carry the displacer in axial reciprocation within the displacer bore to form a clearance seal there between. A gas spring bore is formed within the displacer assembly and communicates with a gas spring volume defined by a volume forming member. A gas spring piston is carried within the gas spring bore and is configured to form a clearance seal there between. The gas spring piston and the gas spring bore cooperate with the volume forming member to form a gas spring there between. One of the gas spring bore and the gas spring piston is carried in fixed relation with the housing while the other of the gas spring bore and the gas spring piston is carried by the displacer for relative reciprocation there between. A thermal regenerative machine having the above-described displacer assembly is also taught.

20 Claims, 4 Drawing Sheets

COMBINATION GAS AND FLEXURE SPRING CONSTRUCTION FOR FREE PISTON DEVICES

TECHNICAL FIELD

This invention relates to internally mounted displacer assemblies for use in power conversion machinery, such as a compressor, an engine, a heat pump, or a Stirling cycle cryogenic cooler.

BACKGROUND OF THE INVENTION

Axially reciprocating displacers in power conversion machinery, such as Stirling cycle machines, have been supported in housings to form clearance seals between portions of a reciprocating displacer and the housing. A typical displacer forms a piston that is movably carried within the housing. Reciprocating movement of the displacer within a chamber of the housing transfers working fluid between the front and back sides of the displacer, causing a thermodynamic transformation there between. Movement of the displacer occurs between a compression space, having a temperature somewhat above ambient, and an expansion space, having a low temperature (when configured in a cooler) or high temperature (when configured in an engine).

In one case, for a Stirling cryocooler, an end portion of a reciprocating displacer forms a drive area in fluid contact with the compression space. The displacer end portion slidably extends through a bore in the housing in fluid communication with a compression space of a linear drive motor. The drive motor has a driving piston that operates on working gas in the compression chamber. The working gas then directly works on the displacer to produce motion. Hence, the driving piston and displacer form a free piston machine, cooperating solely by action of the working fluid. A clearance seal is typically provided between the displacer end portion and the housing bore by maintaining an accurate reciprocating motion of the displacer and by providing an accurate relative sizing of the bore in the housing with the working piston and displacer end portion. The expansion space draws heat from a surrounding cold head, imparting cooling there along. The same construction can form a Stirling engine, by simply imparting heat to the cold head, causing the displacer to reciprocate, and moving the linear drive motor (which now acts as a linear alternator) to produce electric power.

Techniques previously identified for supporting a displacer in a sprung configuration within a housing chamber in power conversion machinery include 1) flexural bearings used to accurately position a reciprocating member in a housing with respect to a clearance seal, and 2) gas spring/bearing supports/seals used to spring a free piston displacer.

In Stirling cycle machines having movable free piston displacers, such as engines and coolers, the displacer has to operate in a near resonant condition. Otherwise, the displacer can move out of phase with the alternator/motor piston, causing a serious or inoperative condition. One previously utilized technique for springing a displacer involves the use of a gas spring on a free piston displacer. For cases where the displacer is sprung to ground via a gas spring, gas forces on the displacer rod provide only a portion of the spring effect required for a displacer that is sprung to ground. The resulting amount of spring is generally only a small fraction of the spring necessary to impart a resonant condition for a displacer of typical size and mass.

For Stirling cycle machines having piston displacers sprung to ground with flexure bearings, the flexure bearings provide an axial spring effect as well as a non-contact operation of the displacer and associated rod seal. Generally, the sum total of axial spring forces produced from each flexure of an assembly is frequently not sufficient to provide a spring force sufficient to impart near resonant conditions. Therefore, it becomes necessary to add additional flexures. Depending on the specific flexure design and mounting technique being employed, the additional number of flexures that are needed can be significant. In some cases, particularly at high operating frequencies and/or with relatively large and heavy displacers, it may be physically impossible to provide the number of flexures that are required to realize the required resonant condition. Adding extra spring flexures increases the moving mass, which necessitates adding additional springs to achieve a desired spring/mass ratio. However, for conditions where a high spring/mass ratio is necessary (i.e. high frequencies), the moving mass of the flexure may prevent one from ever realizing the desired spring/mass ratio.

Therefore, there is a need to provide an improved displacer spring construction that makes it physically possible to realize near resonant operating frequencies, particularly at high operating frequencies and/or for heavy displacer masses. The present invention also arose from an effort to develop such an improved construction in a simplified, economical, and cost effective manner.

BRIEF DESCRIPTION OF THE DRAWINGS

Preferred embodiments of the invention are described below with reference to the following accompanying drawings.

DETAILED DESCRIPTION

This disclosure of the invention is submitted in furtherance of the constitutional purposes of the U.S. Patent Laws "to promote the progress of science and useful arts" (Article 1, Section 8).

The basic elements of the invention are described with reference to conventional components of an integral, free-piston Stirling Cycle Refrigerator or generator. The features disclosed in this invention can also be applied to other non-rotating linear reciprocating members used within power conversion machinery, such as a split Stirling refrigerator, any configuration of Stirling engines, a fluid compressor, a pump, a linear alternator or generator, and other thermodynamic cycle devices which require linear reciprocation of a displacer and/or piston, such as the expander portion of a Gifford McMahon cooling machine.

In accordance with one aspect of this invention, a displacer assembly for use in a thermal regenerative machine has a housing with a displacer bore configured to carry a displacer in the displacer bore. A flexure bearing assembly is configured to carry the displacer in axial reciprocation within the displacer bore to form a clearance seal there between. A gas spring bore is formed within the displacer assembly and communicates with a gas spring volume defined by a volume forming member. A gas spring piston is carried within the gas spring bore and is configured to form a clearance seal there between. The gas spring piston and the gas spring bore cooperate with the volume forming member to form a gas spring there between. One of the gas spring bore and the gas spring piston is carried in fixed relation with the housing while the other of the gas spring bore and the gas spring piston is carried by the displacer for relative reciprocation there between.

In accordance with another aspect of this invention, a thermal regenerative machine includes a linear motor having a driving piston configured to operate in fluid communication with a compression chamber. The machine also includes a displacer assembly having a displacer in fluid communication with the compression chamber, the displacer assembly having: a) a housing having a displacer bore; b) a displacer carried in the displacer bore; c) a flexure bearing assembly configured to carry the displacer in axial reciprocation within the displacer bore, forming a clearance seal there between; d) a gas spring bore formed within the displacer assembly and communicating with a gas spring volume defined by a volume forming member; and e) a gas spring piston carried within the gas spring bore and configured to form a clearance seal there between, the gas spring piston and the gas spring bore cooperating with the volume forming member to form a gas spring there between; one of the gas spring bore and the gas spring piston being carried in fixed relation with the housing, with the other of the bore and the gas spring piston being carried by the displacer for relative reciprocation there between.

Figure 1:
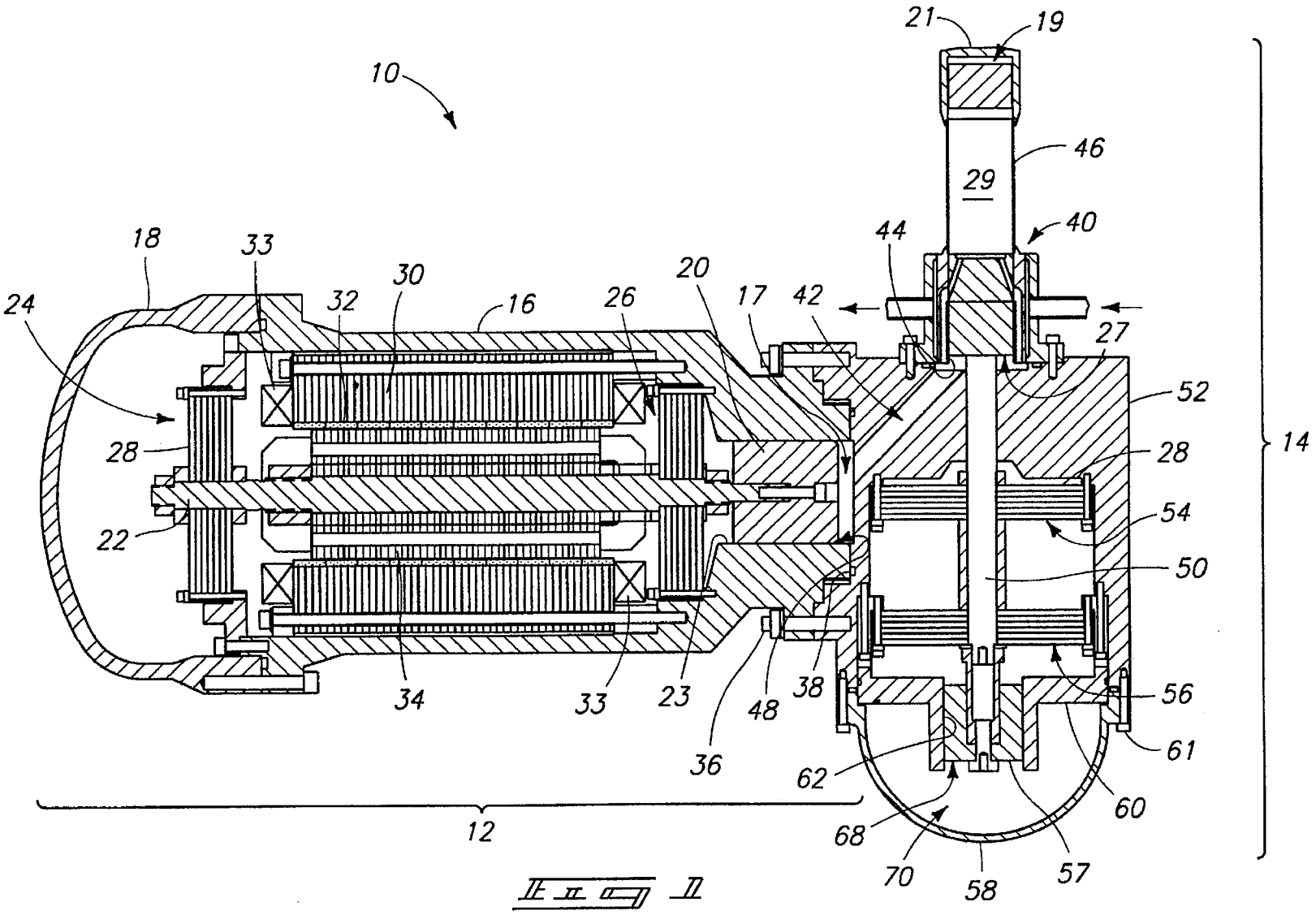
FIG. 1 is a vertical sectional view of a Stirling Cycle cryogenic cooler having improved spring features embodying this invention.

FIG. 1 schematically illustrates a construction for a Stirling Cycle Cryogenic Cooler 10 of this invention. Cooler 10 is formed by assembling together a linear drive motor, or compressor 12 and a separate displacer assembly 14. The cryogenic cooler 10 is a thermal regenerative machine configured in operation to house a gaseous working fluid. Linear drive motor 12 operates to alternately compress and expand working fluid within a compression chamber (hot space) 17 in fluid communication via a fluid flow path with an expansion chamber (cold space) 19. A portion of the working fluid within expansion chamber 19 cools an end cap 21 of the displacer assembly 14 each time it is expanded. To enhance performance, spring improvements according to this invention have been implemented to movably support the internal working components of displacer assembly 14, as will be discussed below.

With the exception of the below-mentioned novel displacer spring aspects, a Stirling cycle machine similar to Stirling cooler 10 is disclosed in our U.S. patent application Ser. No. 08/585,038, filed on Jan. 11, 1996 and entitled "A Stirling Cycle Cryogenic Cooler", listing inventors as Laurence B. Penswick and Ronald E. Neely.

Linear drive motor 12 has a motor housing 16 that cooperates in assembly with an end cap 18. The housing 16 and end cap 18 form an inner chamber in which a piston 20 is supported on a piston rod 22 for reciprocation within a piston bore 23. Bore 23 is constructed and arranged to receive piston 23 in non-contact reciprocation therein, via a pair of flexure assemblies 24 and 26. As shown in FIG. 1, piston 20 is driven in axial reciprocation within bore 23 by way of an electric motor formed by linear motor 12. Piston 20 acts on, or drives the working fluid within compression chamber 17 and expansion chamber 19 via a fluid flow path formed there between. Any of a number of presently known fluid flow path constructions can be used to transfer working gases between the compression chamber 17 and the expansion chamber 19.

A suitable construction for a linear alternator having a nearly identical construction to linear motor 12, except that it is configured to generate power is disclosed in our U.S. patent application Ser. No. 08/637,923, filed on May 1, 1996 and entitled "Heater Head and Regenerator Assemblies for Thermal Regenerative Machines", listing inventors as Laurence B. Penswick and Ray Erbeznik.

Construction details of the linear motor 12 are disclosed in Applicant's U.S. Pat. No. 5,315,190, entitled "Linear Electrodynamic Machine and Method of Using Same", herein incorporated by reference. An array of stationary iron laminations 30 are secured via a plurality of fasteners within housing 16. The stationary laminations 30 form a plurality of spaced apart radially extending stationary outer stator lamination sets defining a plurality of stator poles, winding slots, and magnetic receiving slots. An array of annular shaped magnets 32 are bonded to the inner diameter of stationary laminations 30 for the purpose of producing magnetic flux. Each magnet 30 is received and mounted within the plurality of magnet receiving slots. Furthermore, each of the magnets has an axial polarity and copper coils 33 are placed in slots surrounding the magnets.

As shown in FIG. 1, an array of moving iron laminations 34 are secured to shaft 22, such that the shaft and laminations move in reciprocating motion along with piston 20. A plurality of threaded fasteners are received through radially spaced apart through holes in each lamination 34, trapping the laminations 34 between a pair of retaining collars carried on shaft 22. One collar is axially secured onto shaft 22 with threads where it also seats against a shoulder on the shaft 22. Relative motion between moving laminations 34 and stationary laminations 30 is produced by applying electrical power, or alternating current to the coils 33 by way of an electrical cord that extends through a power feed in housing 16. To facilitate assembly of the alternator, a mounting ring is used to support shaft 22 by means of flexure bearing assembly 24 opposite from piston 20. A plurality of threaded fasteners are used to retain the ring to the housing.

A suitable flexure 28 for use in flexure assemblies 24 and 26 is disclosed in our U.S. patent application Ser. No. 08/105,156, filed on Jul. 30, 1993 and entitled "Improved Flexural Bearing Support, With Particular Application to Stirling Machines", listing the inventor as Carl D. Beckett, et. al. This Ser. No. 08/105,156 application, which is now U.S. Pat. No. 5,522,214, is hereby incorporated by reference.

As shown in FIG. 1, a displacer 27 carried within displacer assembly 14 moves the working fluid between chambers 17 and 19 pursuant to a Stirling thermodynamic refrigeration cycle. As a result, cold head 21 draws away heat from the surrounding environment along the cold head end of cooler 10. In order to enhance thermodynamic efficiency of displacer assembly 14, a regenerator 29 is also provided in-line and in fluid communication with the fluid flow path between compression chamber 17 and expansion chamber 19.

Figure 2:
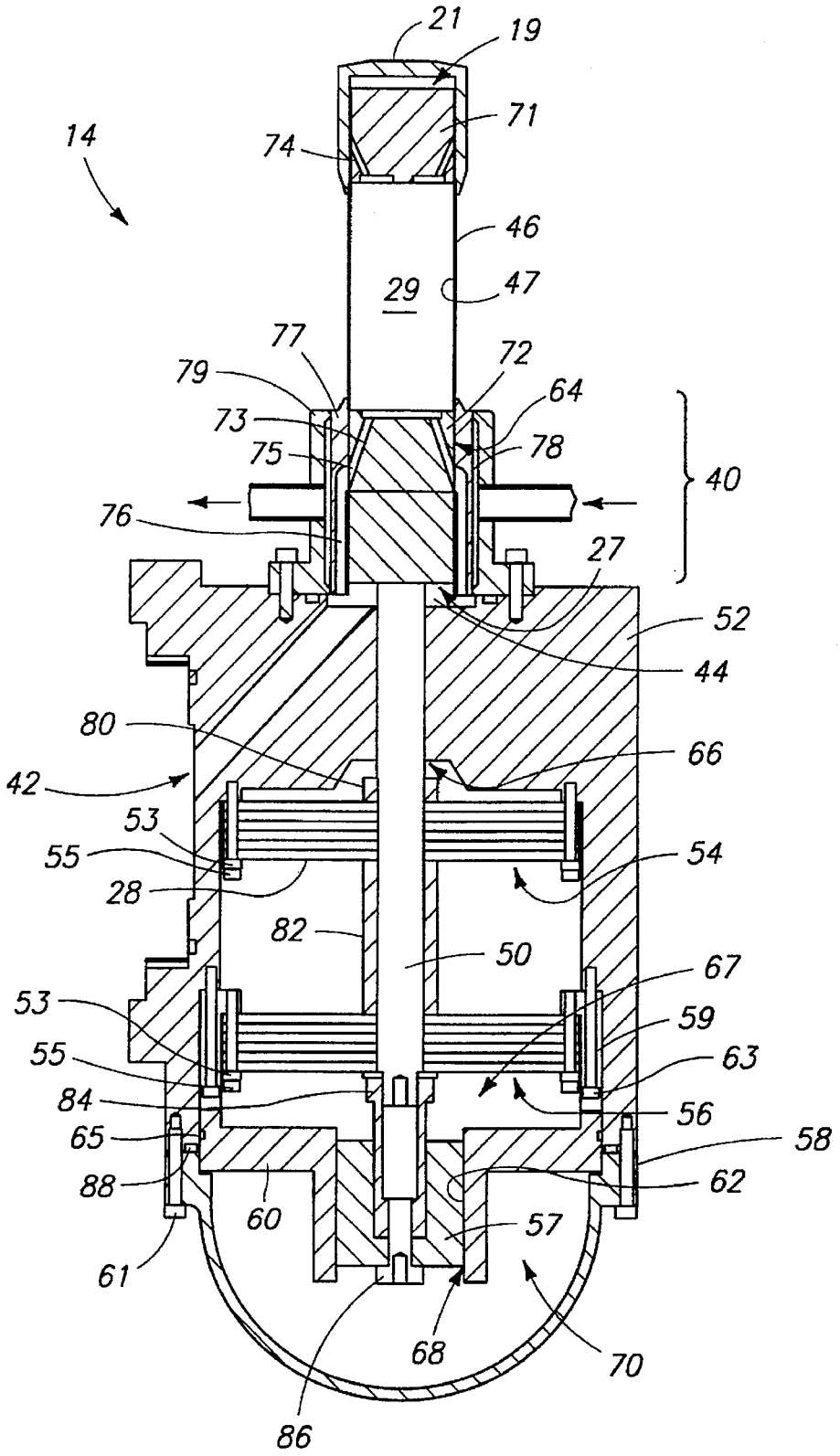
FIG. 2 is an enlarged vertical sectional view of the Stirling Cycle cryogenic cooler assembly of FIG. 1.

Displacer 27 of FIG. 2 is carried for reciprocation within tube 46 in coaxial relation therein, providing a clearance seal 64 therebetween. Displacer 27 is formed by brazing a top plug 71 and a bottom plug 72 to each end of tube 47. Regenerator 29 is formed between plugs 71 and 72 by inserting a plurality of sintered wire disks within tube 47. The disks are formed from cut-out portions of wire screen having a capacity for rapidly transferring and storing heat.

Alternatively, random fibers or wires can be packed therein, having only limited adjoining contact between adjacent pieces. One construction utilizes disks formed from stainless steel screen.

Plug 72 is sized to maintain clearance seal 64 between the plug 71 and an outer tube 46. A plurality of ports 74 extend through plug 71, from a circumferential outer surface to an annular groove formed in an end face of plug 71 adjacent regenerator 29. In this manner, working gases pass between regenerator 29 and expansion chamber 19.

Plug 72 is also sized to maintain a clearance seal 64 between the plug 72 and an outer tube 46. Furthermore, inner tube 47 which extends between plugs 71 and 72 also maintains clearance seal 64 with outer tube 46. A plurality of ports 73 extend through plug 72, from a groove formed in a circumferential outer surface to an annular cavity 76 formed between plug 72 and heat rejector 40. Cavity 76 communications with delivery port 42 via an annular gap formed along a bottom end of plug 72. In this manner, working gases pass between regenerator 29 and compression chamber 17 (of FIG. 1).

A fluid flow path is provided generally between opposite ends of displacer 27 by way of ports 74, regenerator 29, ports 73, annular groove 75, annular cavity 76, and delivery port 42. Pressure variations at port 42 produced by motor 12 cause the sprung motion of displacer 27 within tube 46, which causes the transfer of working gases there through. As a result, working gas is transferred between the compression chamber 17 (of FIG. 1), via delivery port 42, the regenerator 29, and a fluid flow path extending between regenerator 29 and expansion chamber 19.

Heat rejector 40 of FIG. 2 is implemented on displacer assembly 14 to improve the thermodynamic efficiency. Heat rejector 40 has an inner wall 77 and an outer wall 79, between which a circumferential fluid cooling cavity 78 is formed. Inner wall 77 also supports an outer tube 46 and cold head 21. To cool working gases in the region of plug 72, a flow of cooling fluid is passed through cavity 78 via an inlet and an outlet. Water provides one suitable cooling fluid. Various alternative thermally conductive fluids can also be used, including thermally conductive gases.

To facilitate assembly and maintenance, cold head 21, outer tube 46, and heat rejector 40 are brazed together, then mounted in sealed engagement with housing 52 via a plurality of threaded fasteners and a circumferential seal. As shown in FIG. 2, tube 46 is fitted and received within a circumferential recess of inner wall 77 where it is brazed completely around its circumference. Similarly, tube 46 is fitted and received within a circumferential recess of cold head 21 where it is brazed.

Also shown in FIG. 2, displacer 27 is mounted to reciprocate within displacer bore 44 of displacer housing 52 via a pair of flexure bearing assemblies 54 and 56. Assemblies 54 and 56 are secured to displacer rod 50 along an inner aperture. Similarly, assemblies 54 and 56 are secured to housing 52 along an outer diameter portion. Inner aperture of assembly 54 is loaded onto rod 50, and seated against enlarged shoulder 80 of rod 50, after which cylindrical spacer 82 is received over rod 50, entrapping assembly 54 there between. Inner aperture of assembly 56 is then loaded onto rod 50, against spacer 82, while the outer diameter is received in a retaining ring 59. A threaded post 84 is then mated with a threaded end on rod 50, trapping assembly 56 thereon. Outer diameter portions of assemblies 54 and 56 are then mounted to housing 52 via a retaining ring 53 and a plurality of threaded fasteners 55. Accordingly, a fastener is received through each aperture in each flexure 28 of each assembly.

In operation, opposite ends of displacer 27 form a drive area and an expansion area, respectively. These areas are acted on by pressure differentials in the working fluid, as are other areas within the displacer assembly, causing the displacer to reciprocate therein. Pressure differentials acting on the displacer act against the spring forces of flexures 28 which tend to hold the displacer 29 in a centered stationary position. However, pressure variations acting on the displacer can cause the displacer to move, overcoming the spring forces of the flexures. In this manner, the displacer 27 is supported for reciprocation within an inner chamber 67 of housing 52 by the pair of internally mounted flexure bearing assemblies 54 and 56.

A gas spring piston 57 carried on rod 50 contributes to the novel features of this invention, as shown in FIGS. 1 and 2. Namely, FIG. 2 illustrates piston 57 as it is carried by post 84 with a threaded faster 86. Hence, piston 57 reciprocates with rod 50, within a gas spring bore 62 of an internal bulkhead 60, forming a clearance seal 68 there between. Bulkhead 60 is mated in aligned and sealed engagement with housing 52 via a resilient circumferential seal 65 and a plurality of threaded fasteners. An end cap, or volume forming member 58 is then mated in sealed engagement to the end of housing 52 via a resilient circumferential seal 88 and a plurality of threaded fasteners 61. End cap 58 comprises a gas spring volume forming member.

Inner chamber 67 is formed within housing 52, along the top of piston 57, as shown in FIG. 2. An outer chamber, or gas spring volume 70 is formed between bulkhead 60 and end cap 58, along the bottom of piston 57. Reciprocating movement of displacer 27, rod 50 and piston 57 results from the combined spring forces produced by the flexures 28 of assemblies 54 and 56, and the pressure differential created between inner chamber 67 and gas spring volume 70, as it acts on piston 57. In other words, a gas spring effect is created by the action of piston 57 within bore 62. Such a combination of spring forces creates the beneficial features of this invention. Namely, a spring force is created by both the gas spring volume 70 acting on piston 57 and axial displacement of the flexure bearing assemblies 54 and 56.

Particularly at high operating frequencies and/or with relatively large and heavy displacers, it may be physically impossible to provide the number of flexures that are required to realize the required resonant condition, where use of the gas spring volume is not made available. There may not be enough room available to accommodate extra flexures. Alternatively, the added mass resulting from additional flexures might simply exceed the mass allowed by present design constraints. For example, it may be important to produce a light weight device for portable applications, requiring weight reduction wherever possible. Hence, a required displacer spring constant can be realized without having to resort to adding additional flexure springs, causing a concurrent increase in mass.

Figure 3:
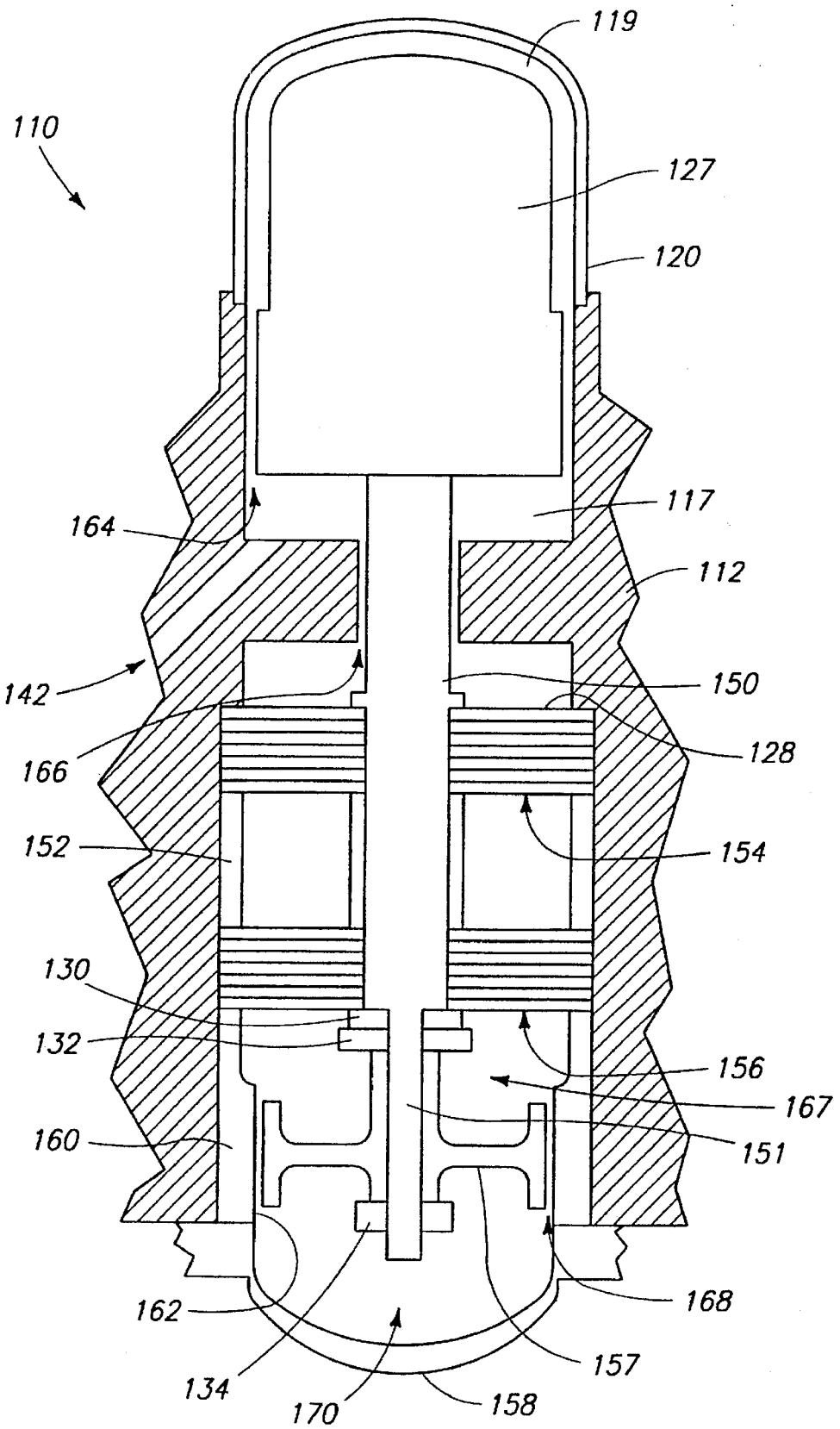
FIG. 3 is a simplified schematic cross-sectional view of a Stirling Cycle generator having improved spring features embodying this invention.

FIG. 3 illustrates the gas spring assisted flexure bearing assembly arrangement of FIGS. 1 and 2 as applied to a Stirling engine module 110 configured for mating in assembly with a power module (not shown). The engine and power modules form a Stirling power generator, wherein heat is applied to a displacer assembly of engine module 110, causing displacer 127 to reciprocate. As a result, working fluid pressure changes travel by way of port 142 to the power module where there are converted into electrical energy. Details of a suitable power module construction are disclosed in applicant's co-pending U.S. patent application Ser. No. 08/637,923, filed on May 1, 1996 and entitled "Heater Head and Regenerator Assemblies for Thermal Regenerative Machines", listing inventors as Laurence B. Penswick and Ray Erbeznik, which has already been incorporated by reference.

Engine module 110 of FIG. 3 is formed from a housing 112, a heater head 120, an end cap 158, and a displacer assembly that is carried within the housing. The displacer assembly includes displacer 127, a displacer rod 150, a pair of flexure bearing assemblies 154 and 156, and gas spring piston 157. The construction and assembly of gas spring piston 157 and flexure bearing assemblies 154 and 156 are virtually the same as those depicted in the device of FIGS. 1 and 2. End cap 158 comprises a gas spring volume forming member. Accordingly, displacer 127 reciprocates in operation between a compression chamber (warm space) 117 and an expansion chamber (hot space) 119 as heat is applied to head 120. A clearance seal 164 is formed between displacer 127 and the surrounding housing 112 and head 120. Flexure bearing assemblies 154 and 156 are mounted in spaced apart relation on rod 150 via one or more cylindrical spacers 152 and a washer 130 and threaded nut 132. To facilitate assembly, a reduced diameter portion 151 of rod 150 receives washer 130 and nut 132. Additionally, piston 157 is received on portion 151. A threaded nut 134 is then mated with a corresponding threaded portion of reduced diameter portion 151, trapping piston 157 and flexure bearing assemblies 154 and 156 onto rod 150.

As depicted in FIG. 3, an outer diameter of flexure bearing assembly 156 is retained in fixed position within housing 112 by a cylindrical body 160. Body 160 has a threaded outer diameter (not shown) which mates in threaded engagement with a corresponding threaded inner diameter of housing 112. A piston bore 162 is also constructed and arranged on an inner surface of body 160 for receiving piston 157. Piston 157 reciprocates within bore 162 as displacer 127 reciprocates within housing 112, forming a clearance seal 168 there between.

To seal working gas within engine 110, an end cap 158 is mounted over the open end of housing 112 where it is sealed with an o-ring (not shown) and secured with fasteners (not shown). End cap 158 is constructed and arranged to form a hemispherical portion that imparts a desired volume to a gas spring volume 170 that is defined between end cap 158 and the bottom side of piston 157. Motion of piston 157 changes the size of volume 170, causing an increase in pressure as piston 157 moves down (decreasing the volume) and a decrease in pressure as piston 157 moves up (increasing the volume). In contrast, the pressure inside inner chamber 167 remains relatively uniform. Therefore, a pressure differential is created across piston 157 as it moves from its centered position, creating a spring-like force on rod 150 as displacer 127 reciprocates. Additionally, flexures 128 of assemblies 154 and 156 contribute a spring force that varies with the displacement of rod 150 within housing 112.

Since the piston 157 and flexure bearing assemblies 154 and 156 combine to impart spring-like forces on displacer rod 150, fewer flexures 128 are needed when constructing assemblies 154 and 156. This construction combines the flexures ability to accurately guide the displacer rod and displacer with the intrinsically high spring rate potential of gas springs. The attachment of piston 157 onto the end of displacer rod 150, within the enclosed volume that surrounds the piston makes it possible to form a gas spring with non-contact between the piston and bore 162. According to the displacer configurations depicted in FIGS. 1–3, the gas spring is attached to the end of the displacer rod opposite the displacer.

Figure 4:
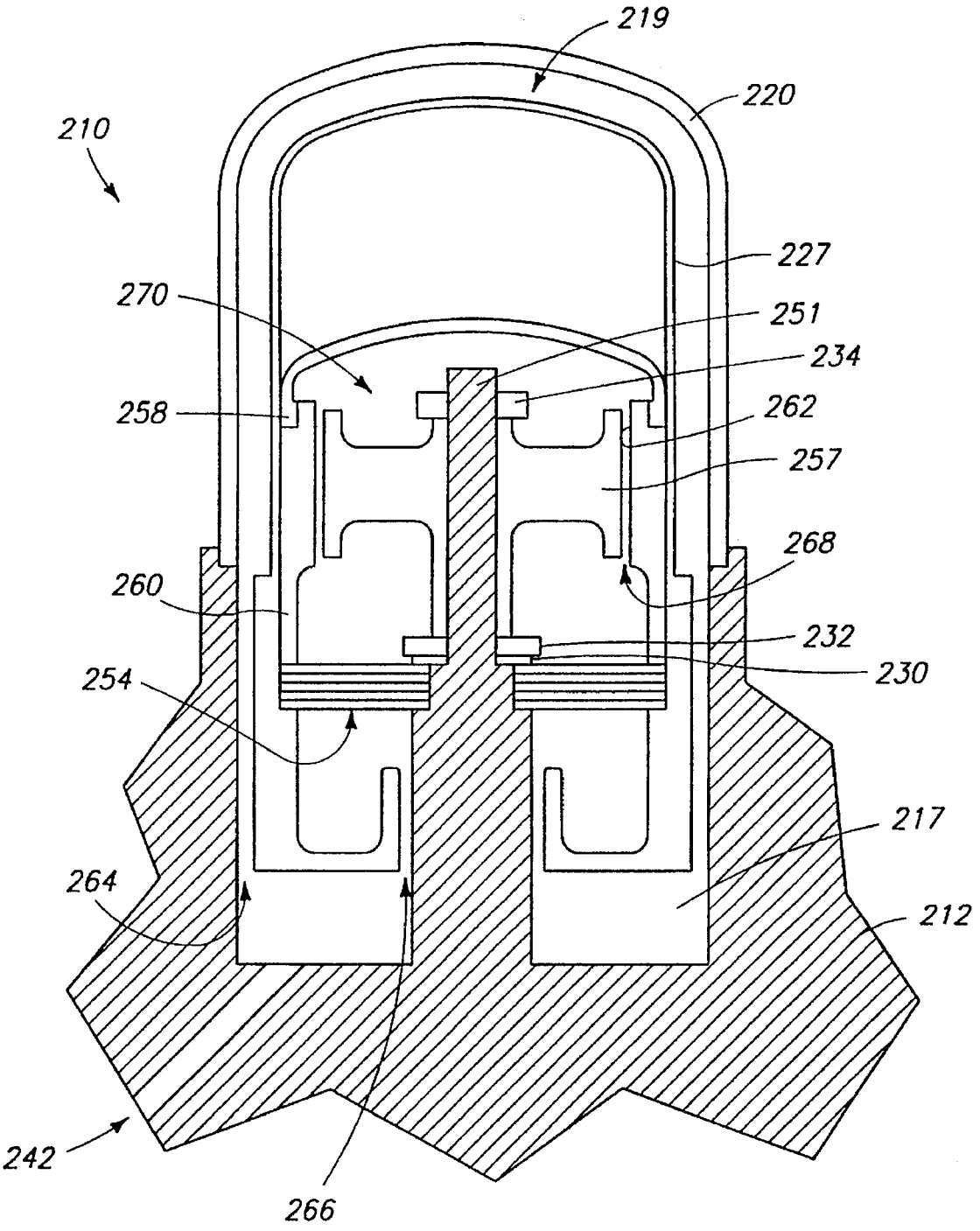
FIG. 4 is a simplified schematic cross-sectional view of a Stirling Cycle generator having alternatively constructed improved spring features embodying this invention.

Alternatively, FIG. 4 illustrates a construction of a Stirling engine module 210 where the gas spring is located within the displacer, in combination with a flexure assembly 254. The gas spring comprises a stationary piston 257 and moving receiving bore 262, between which a gas spring clearance seal 268 is formed there between. Bore 262 is formed within moving displacer 227. Additionally, an internal end cap 258 is mounted within displacer 227, forming a gas spring volume 270 between piston 257 and end cap 2580 Hence, end cap 258 comprises a gas spring volume forming member. In operation, bore 262 reciprocates about piston 257, causing the size of volume 270 to vary, and forming a gas spring that acts on reciprocating displacer 227 as it moves. The space, or volume between piston 257 and the inside of displacer 227 adjacent to flexure assembly 254 can also act as a gas spring space, equivalent to volume 270. Hence, a "double acting" gas spring configuration is produced, as a result.

Engine module 210 is formed by joining together a housing 212 and a heater head 220, forming a chamber in which a displacer assembly is enclosed, according to FIG. 4. Displacer 227 is supported within the chamber via a flexure bearing assembly 254, forming a displacer clearance seal 264 there between. When heat is applied to heater head 220, displacer 227 reciprocates between a compression chamber 217 and an expansion chamber 219. Typically, compression chamber 217 would be connected via port 242 with a power piston of a linear alternator (not shown), with resulting pressure oscillations in chamber 217 causing the alternator to produce electricity.

Displacer 227 and piston 257 are commonly supported on a single stationary post 251. Flexure bearing assembly 254 is received on a stepped down portion of post 251, above which a washer 230 and a threaded nut 232 are received on a further reduced diameter portion of post 251. Piston 257 is then secured onto post 251, between nut 232 and a second threaded nut 234. An outer diameter of flexure bearing assembly 254 is secured to an inner diameter of displacer 227 by trapping it between a lip edge inside the displacer and an externally threaded cylinder bore body 260. Body 260 mates in threaded engagement with a complementary threaded bore within displacer 227, trapping assembly 254 against a lip shelf therein. End cap 258 mates in threaded engagement with a threaded lip on body 260, encasing gas spring volume 270 therein.

The resulting assembly of FIG. 4 accurately suspends displacer 227 for reciprocation in housing 212, while realizing displacer clearance seal 264, displacer rod seal 266, and gas spring clearance seal 268 therein.

Alternatively, the displacer support constructions of FIGS. 3 and 4 can be implemented on a Stirling cryocooler, a fluid compressor, a pump, a linear alternator or generator, and other thermodynamic cycle devices which require linear reciprocation of a displacer and/or piston, such as the expander portion of a Gifford McMahon cooling machine.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A displacer assembly for use in a thermal regenerative machine, comprising:

a housing having a displacer bore;

a displacer carried in the displacer bore;

a flexure bearing assembly configured to carry the displacer in axial reciprocation within the displacer bore, forming a clearance seal there between;

a gas spring bore formed within the displacer assembly and communicating with a gas spring volume defined by a volume forming member; and a gas spring piston carried within the gas spring bore and configured to form a clearance seal there between, the gas spring piston and the gas spring bore cooperating with the volume forming member to form a gas spring there between;

one of the gas spring bore and the gas spring piston being carried in fixed relation with the housing, with the other of the bore and the gas spring piston being carried by the displacer for relative reciprocation there between.

2. The displacer assembly of claim 1 wherein the gas spring bore is formed from the housing, and the gas spring piston is carried by a displacer rod within the gas spring bore.

3. The displacer assembly of claim 1 wherein the gas spring bore is formed from an inner diameter of the displacer, and the gas spring piston is carried by a stationary displacer mounting post configured to carry the displacer via the flexure bearing assembly.

4. The displacer assembly of claim 1 wherein the gas spring volume forming member comprises an end cap carried by the housing.

5. The displacer assembly of claim 1 wherein a pair of flexure bearing assemblies provided in spaced apart relation carry the displacer for reciprocation within the housing bore.

6. The displacer assembly of claim 1 wherein the displacer assembly is a Stirling cryocooler displacer assembly.

7. The displacer assembly of claim 1 wherein the displacer assembly is a Stirling engine displacer assembly.

8. The displacer assembly of claim 1 wherein the gas spring bore comprises an aperture in an internal bulkhead carried within the housing.

9. The displacer assembly of claim 1 wherein the displacer bore is concentric with the gas spring bore.

10. The displacer assembly of claim 1 wherein the gas spring piston is carried in fixed relation with the housing.

11. The displacer assembly of claim 1 wherein the volume forming member comprises an end cap carried internally of the displacer.

12. The displacer assembly of claim 1 wherein the volume forming member comprises an interior surface of the displacer.

13. The displacer assembly of claim 1 wherein the gas spring volume forming member is carried internally of the displacer, the piston, gas spring bore, and gas spring volume forming member cooperating to define the gas spring volume there between.

14. The displacer assembly of claim 13 wherein the gas spring bore comprises an internal bulkhead configured to be carried by the housing beneath the end cap and having an aperture sized to receive the gas spring piston, in assembly, the internal bulkhead, the piston, and the end cap cooperating to define the gas spring volume there between.

15. A displacer assembly for use in a thermal regenerative machine, comprising:

a housing having a displacer bore;

a displacer carried in the displacer bore;

a flexure bearing assembly configured to carry the displacer in axial reciprocation within the displacer bore, forming a clearance seal there between;

a gas spring bore formed within the displacer assembly and communicating with a gas spring volume defined by a volume forming member; and a gas spring piston carried within the gas spring bore and configured to form a clearance seal there between, the gas spring piston and the gas spring bore cooperating with the volume forming member to form a gas spring there between;

the gas spring bore being carried in fixed relation with the housing, with the gas spring piston being carried by the displacer for relative reciprocation there between.

16. The displacer assembly of claim 15 wherein the volume forming member comprises an end cap of the housing, the end cap configured in relation with the gas spring bore and the gas spring piston to define the gas spring volume there between.

17. A displacer assembly for use in a thermal regenerative machine, comprising:

a housing having a displacer bore;

a displacer carried in the displacer bore;

a flexure bearing assembly configured to carry the displacer in axial reciprocation within the displacer bore, forming a clearance seal there between;

a gas spring bore formed within the displacer assembly and communicating with a gas spring volume defined by a volume forming member; and a gas spring piston carried within the gas spring bore and configured to form a clearance seal there between, the gas spring piston and the gas spring bore cooperating with the volume forming member to form a gas spring there between;

the gas spring piston being carried in fixed relation with the housing, with the gas spring bore being carried by the displacer for relative reciprocation there between.

18. The displacer assembly of claim 17 wherein the volume forming member comprises an interior of the displacer, the interior configured in relation with the gas spring bore and the gas spring piston to define the gas spring volume there between.

19. A thermal regenerative machine, comprising:

a linear motor having a driving piston configured to operate in fluid communication with a compression chamber;

a displacer assembly having a displacer in fluid communication with the compression chamber, the displacer assembly having;

a) a housing having a displacer bore;

b) a displacer carried in the displacer bore;

c) a flexure bearing assembly configured to carry the displacer in axial reciprocation within the displacer bore, forming a clearance seal there between;

d) a gas spring bore formed within the displacer assembly and communicating with a gas spring volume defined by a volume forming member; and e) a gas spring piston carried within the gas spring bore and configured to form a clearance seal there between, the gas spring piston and the gas spring bore cooperating with the volume forming member to form a gas spring there between;

one of the gas spring bore and the gas spring piston being carried in fixed relation with the housing, with the other of the bore and the gas spring piston being carried by the displacer for relative reciprocation there between.

20. The displacer assembly of claim 19 wherein the gas spring bore is formed from the housing, and the gas spring piston is carried by a displacer rod within the gas spring bore.

* * * * *